US005133169A

United States Patent [19]

Tesch, Jr. et al.

[11] Patent Number: 5,133,169

[45] Date of Patent: Jul. 28, 1992

[54] APPARATUS FOR DENESTING PLANT FLATS AND POTS AND DEPOSITING POTS WITHIN FLATS

[75] Inventors: Sylvester M. Tesch, Jr., S9023 Timbercrest Trail, Praire du Sac, Wis. 53578; Bruce L. Bierman, Prairie du Sac, Wis.

[73] Assignee: Sylvester M. Tesch, Jr., Prairie du Sac, Wis.

[21] Appl. No.: 727,882

[22] Filed: Jul. 10, 1991

[51] Int. Cl.[5] ..... B65B 5/08; B65B 35/36

[52] U.S. Cl. ..... 53/247; 53/250

[58] Field of Search ..... 53/247, 250, 249, 235; 221/211, 200

[56] References Cited

U.S. PATENT DOCUMENTS

| | | | |
|---|---|---|---|
| 3,090,523 | 5/1963 | Packman | 221/36 |
| 3,108,714 | 10/1963 | O'Brien | 221/211 |
| 3,256,008 | 6/1966 | Bayliss | 271/32 |
| 3,258,155 | 6/1966 | Peppler | 221/36 |
| 3,275,189 | 9/1966 | Goldsborough et al. | 221/36 |
| 3,322,301 | 5/1967 | Bliss | 221/211 X |
| 3,344,552 | 10/1967 | Inman | 221/211 X |
| 3,542,241 | 11/1970 | Middleditch | 221/211 |
| 3,659,744 | 5/1972 | Byrd et al. | 221/211 X |
| 3,907,161 | 8/1975 | Martin | 221/211 |
| 3,940,017 | 2/1976 | Borgstrom | 221/211 |
| 4,008,543 | 2/1977 | Vilt | 47/1 A |
| 4,043,097 | 8/1977 | Ishida et al. | 53/247 X |
| 4,082,203 | 4/1978 | Schjeldahl | 221/211 |
| 4,109,803 | 8/1978 | Quelch | 214/8.5 |
| 4,157,676 | 6/1979 | Schjeldahl | 221/211 |
| 4,270,669 | 6/1981 | Luke | 221/13 |
| 4,312,170 | 1/1982 | Berg et al. | 53/247 |
| 4,567,712 | 2/1986 | Varallo et al. | 53/250 X |
| 4,686,813 | 8/1987 | Sawada | 53/247 X |
| 5,024,048 | 6/1991 | Moore | 53/247 X |

*Primary Examiner*—James F. Coan

*Attorney, Agent, or Firm*—Lathrop & Clark

[57] ABSTRACT

In a continuous cycle the apparatus denests stacked plant pots and plant flats and fills the flats with the pots. Two piston mounted vacuum grippers employing arrays of suction cups are mounted to a frame. The flat gripper moves vertically to destack an array of plant flats or trays, and the pot gripper moves vertically to destack an array of plant pots. Both grippers are moveable between a retracted position, an unloading position, and a multiplicity of loading positions. A carriage is reciprocated on wheels between a first position beneath the flat gripper in its unloading position and a second position beneath the pot gripper in its unloading position.

Stacks of nested plant flats and arrays of stacks of nested pot—both of which may be contained in their original shipping containers—are positioned beneath their respective grippers and aligned with the flat and pot grippers by means of adjustable alignment flanges.

The pot gripper deposits an array of pots into a flat conveyed by the carriage which is then removed from the carriage by an ejecting mechanism. Pneumatic vibrators vibrate the grippers to prevent lifting of multiple units.

12 Claims, 4 Drawing Sheets

APPARATUS FOR DENESTING PLANT FLATS AND POTS AND DEPOSITING POTS WITHIN FLATS

FIELD OF THE INVENTION

This invention relates generally to an apparatus for denesting stacked containers and assembling the denested containers into assemblies and more particularly to an apparatus for filling plant flats with plant pots.

BACKGROUND OF THE INVENTION

The nursery industry commonly utilizes thin-walled plastic pots which contain one or more plants. An array of pots are assembled in a plastic pot flat which allows a number of filled pots to be transported, stored, and sold as a unit. The end user, for example a home gardner, may then remove individual pots from the flat for final disposition of the plant contained therein.

The pots and flats are commonly stackable thermoformed plastic articles, and are supplied to the nursery stacked within cartons.

Conventionally, the pots are arrayed within the flats manually, typically using seasonal labor.

The nestability of the pots and flats advantageously allows large numbers of articles to be conveniently stored in a relatively small volume. The ability to store large numbers of containers at relatively high-bulk density is essential to the economic shipping and storage of the lightweight, plastic containers.

Two problems are associated with using lightweight, nested containers in conjunction with automated machinery. The first is associated with placing the nested containers so that as each container is denested it is presented to the automated handling apparatus at a constant datum. The second problem is associated with ensuring that only one container is removed from the nested stack at a time.

Apparatus for handling nested plastic containers are known which utilize a magazine either gravity- or spring-fed which presents a container to be denested at a constant datum relative to the denesting apparatus. In this type of apparatus, the containers or cups are held in the magazine by a rigid lip or resilient fingers which prevent more than one container from being removed from the magazine at a time. The containers, cups, or trays are normally pulled from the magazine by means of one or more resilient suction cups which are in communication with a vacuum pump. The resilient cups form an air tight seal with one or more surfaces of the container so that atmospheric pressure forces the container against the suction cup firmly attaching it to the gripper as long as the suction cups are in communication with the source of vacuum. The gripper, by means of the suction cups, grips the container and pulls it from the container magazine, in the process either deforming the container to pass by the rigid lip or deforming the resilient retaining fingers. The containers are then either translated or rotated relative to their stacked location and released from the suction cups by connecting the suction cups to a source of atmospheric or superatmospheric pressure. The use of suction cups connected to a vacuum source for gripping the containers is advantageously used in connection with a suction sensitive switch in pneumatic communication with the suction cups so that when the suction cups are sealed against the surfaces of the containers, the suction sensitive switch may initiate the movement of the gripper which removes the container from the nested stack and positions it for further processing.

Increased labor costs in the nursery business has developed a need for automated machinery to reduce the cost of producing transplants and potted plants.

Conventional denesting apparatus which require the use of magazines which require the individual hand loading of the magazines are not readily adaptable to varying numbers of containers of different sizes. Further, conventional destacking apparatus are not well adapted to placing a full array of pots in a flat.

An apparatus is needed for destacking from cartons an array of pots and for further destacking a tray or flat and for depositing the array of pots in the plant flat in a generally automatic fashion.

SUMMARY OF THE INVENTION

The apparatus of this invention denests stacked plant pots and plant trays and fills the flats with the pots. The apparatus employs two piston mounted vacuum grippers employing arrays of suction cups which are mounted to a frame. The first gripper is employed in destacking plant flats or trays, and the second gripper is utilized in destacking an array of plant pots. Both grippers are movable between a retracted position, an unloading position, and a multiplicity of loading positions. Slidably mounted to the frame is a moveable carriage with a first position beneath the flat gripper when it is in its unloading position and a second position beneath the pot gripper in its unloading position.

Stacks of nested plant flats and arrays of stacks of nested pots—both of which may be contained in their original shipping containers—are positioned beneath their respective grippers and aligned with the flat and pot grippers by means of adjustable alignment flanges.

In operation, the flat gripper moves down from its retracted position until a vacuum sensitive switch indicates that the suction cups are engaged with the uppermost flat in the nested stack of flats whereupon the flat gripper retracts to its retracted position. The movable carriage is then positioned beneath the flat gripper which moves to the unloading position and releases the plant flat before returning to the retracted position. The carriage then moves to a position beneath the pot gripper which has been loaded with pots in a manner similar to the flat gripper while the flat gripper was unloading. The pot gripper deposits its array of pots into the flat which is then removed from the carriage by an ejecting mechanism and the process is repeated.

In order to prevent more than the uppermost pot or flat in a stack from traveling with the reciprocating grippers a vibrating means may be mounted on the gripper which causes the grippers to vibrate and so release any pots or flats adhering to the uppermost pot or flat held by the vacuum suction cups.

It is an object of the present invention to provide a destacking apparatus in a pot flat filler which accesses stacked objects at various levels.

It is a further object of the present invention to effectively and repeatably denest stacked flats and pots.

It is another object of the present invention to provide an apparatus for filling plant flats with plant pots.

It is also an object of the present invention to provide an apparatus for destacking plant flats and plant pots and positioning the plant pots within the plant flats which is readily adaptable for use with flats of varying sizes and pots of different sizes configured in arrays of different sizes.

It is a still further object of the present invention to provide an apparatus for destacking plant flats and plant pots, loading the plant pots into the plant flats and further discharging the plant flats loaded with plant pots for further processing.

Further objects, features, and advantages of the invention will be apparent from the following detailed description when taken in conjunction with the accompanying drawings.

DESCRIPTION OF THE PREFERRED EMBODIMENT

Figure 4:
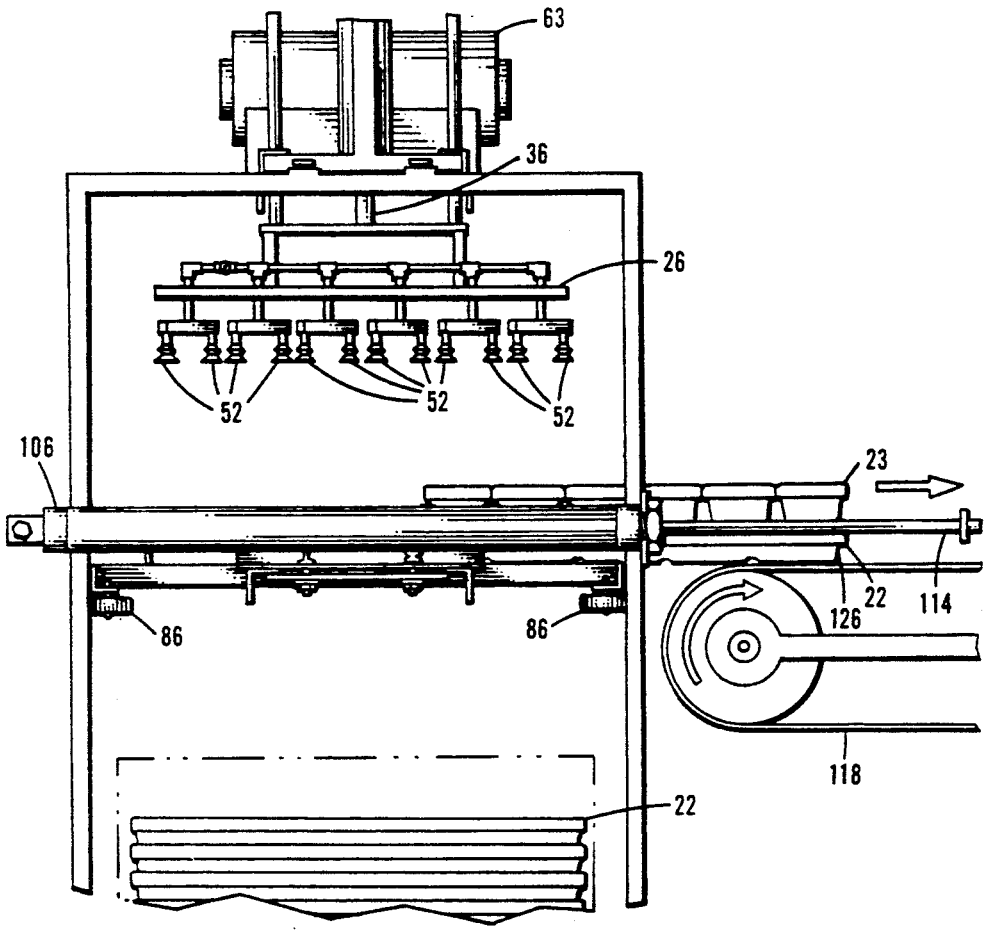
FIG. 4 is a partial side elevational view of the apparatus of FIG. 1 wherein a plant flat filled with plant pots is shown being discharged onto a conveyor belt.
Figure 5:
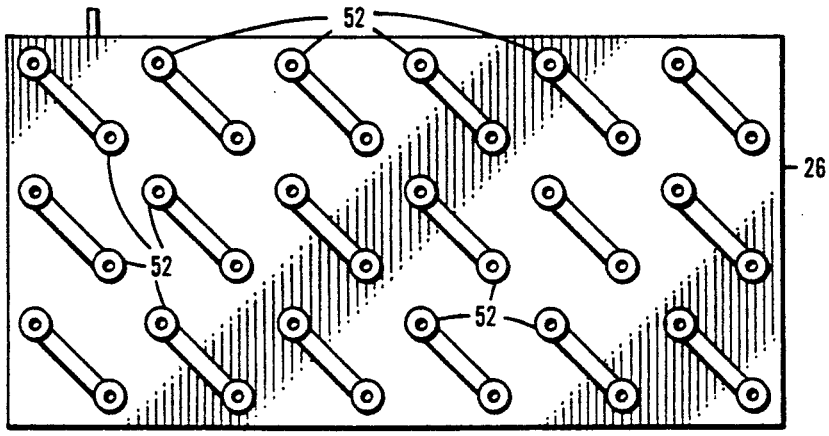
FIG. 5 is a bottom plan view of the pot gripper of FIG. 1.
Figure 6:
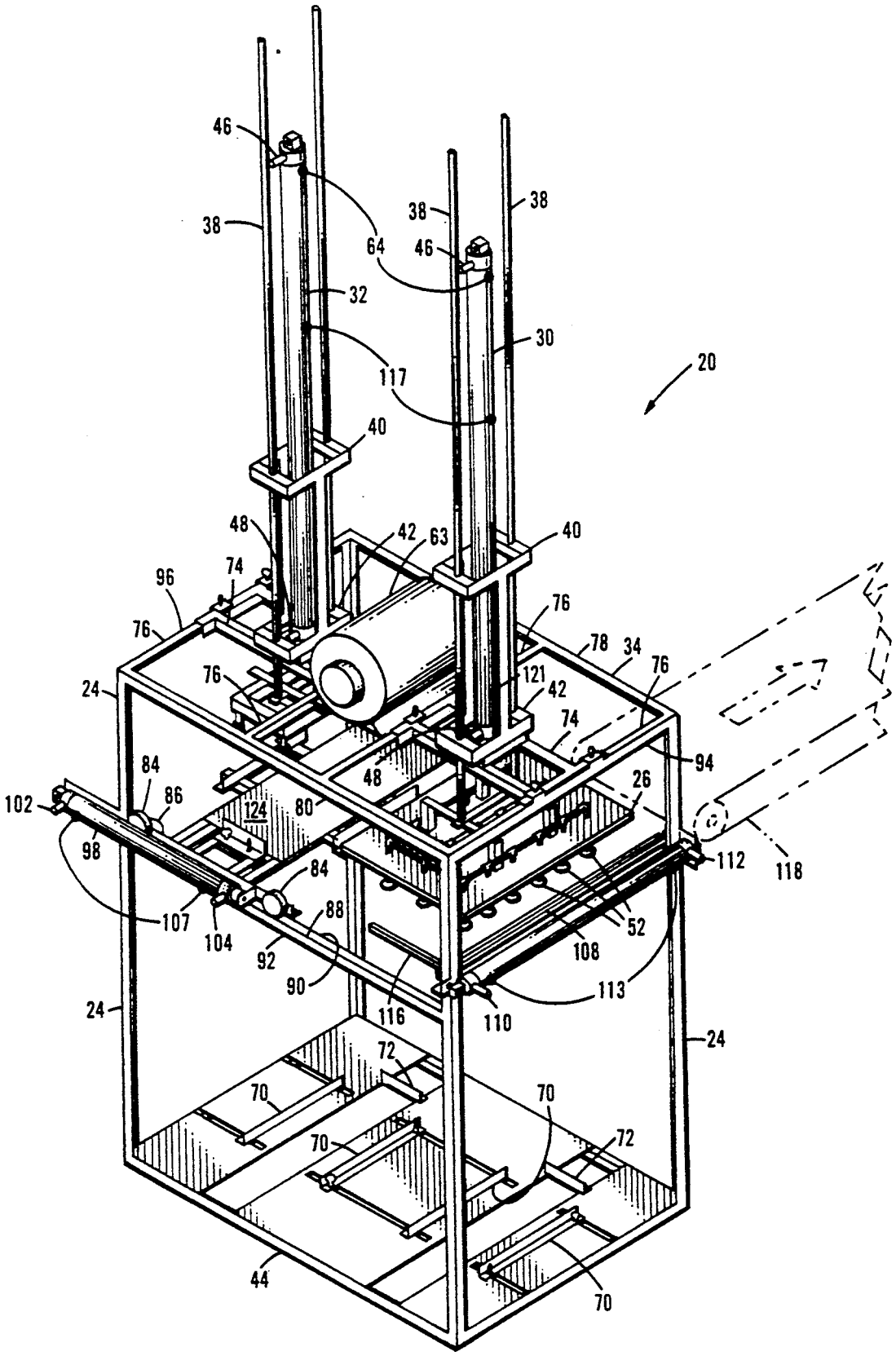
FIG. 6 is an isometric view of the apparatus of FIG. 1.

Referring more particularly to FIG. 1-7 wherein like numbers refer to similar parts, an apparatus 20 is shown in FIG. 6 and its function is illustrated in FIG. 1-4. The apparatus 20 destacks plant flats or trays 22 and loads them with plant pots 23.

As best shown in FIG. 6 the apparatus 20 consists of a frame 24 on which is extensibly mounted a pot gripper 26 and a flat gripper 28.

The grippers 26, 28 are reciprocated by means of pneumatic actuators 30, 32 which are mounted vertically to the top 34 of the frame 24. The pneumatic actuators 30, 32 have central pistons 36 and guide rods 38 which are slidably mounted in upper bushings 40 and lower bushings 42. The guide rods 38 together with the central pistons 36 assure smooth motion of the grippers 26, 28 along a vertical axis, and further assure that the grippers 26, 28 remain horizontal relative to the planes defined by the top 34 and the bottom 44 of the frame 24.

Figure 7:
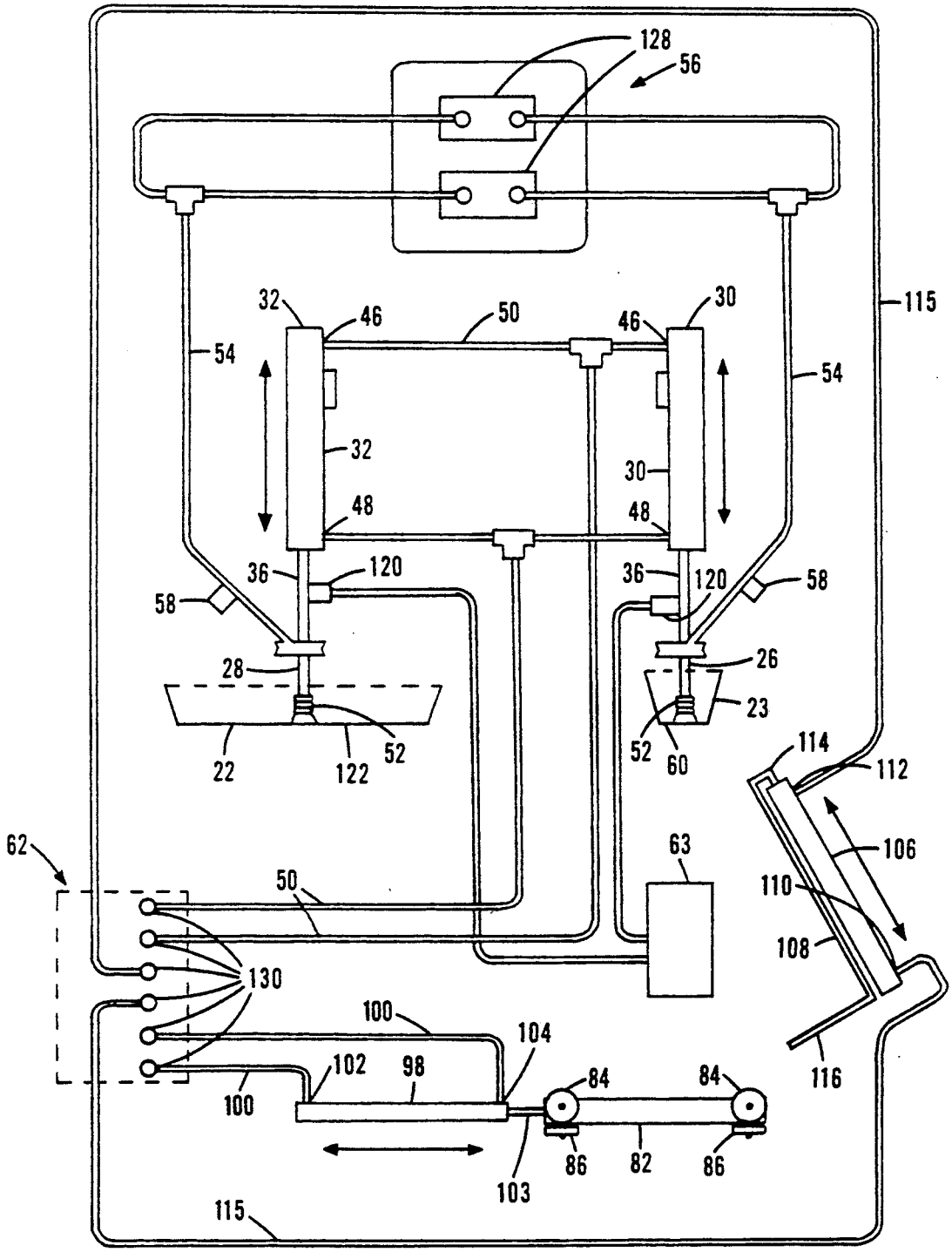
FIG. 7 is a schematic illustration of the functional elements of the apparatus of FIG. 1.

The pneumatic actuators 30, 32 have upper air ports 46 and lower air ports 48 best shown in FIG. 6, and shown schematically in FIG. 7. For clarity, air supply lines have been shown schematically in FIG. 7 and have been omitted from the other views. When compressed air is supplied to the upper port 46 through an air supply line 50 shown in FIG. 7, the compressed air forces the central pistons 36 to extend downwardly from the actuators 30, 32 causing the grippers 26, 28 to extend from their retracted position near the top 34 of the frame 24 towards the bottom of the frame 44 where the pot and flat grippers 26, 28 are brought into contact with stacks of nested pots 23 and nested flats 22 respectively.

The pot gripper 26 has a plate through which extend 18 air pipes. Each pipe terminates in a bar with two suction cups 52. The pipes are connected to one another so a vacuum may be drawn on the connected pipes to engage the gripper with a number of pots.

The number of pipes and suction cups in a pot gripper will depend on the number of pots to be deposited in a particular flat. Thus the pot gripper 26 is exchangeable with similar grippers of having suction cup arrays of differing dimensions.

The pot gripper 26, shown in FIG. 5, destacks an array of 3 by 6 pots and employs two resilient suction cups 52 shown in FIG. 5 to grip each pot in the array for a total of thirty-six suction cups 52 for gripping an array of 18 pots. The suction cups 52 are in pneumatic communication by means of a vacuum line 54 with a vacuum pump or source 56 shown diagrammatically in FIG. 7. Also in pneumatic communication with the suction cups is a suction-sensitive switch 58. When the suction cups 52 are brought into contact with the pot bottoms 60 shown in FIG. 1--3 the suction cups 52 seal to the bottom 60 of the pots and the vacuum source 56 to which the suction cups 52 are connected draws a vacuum on the suction cups and the vacuum-sensitive switch 58 which is in pneumatic communication with the suction cups 52. The suction switch 58 senses the vacuum applied to the suction cups 52 when the gripper 26 is firmly engaged with an entire array of pots 23. The actuation of the vacuum switch 58 is used by a controller 62, shown diagrammatically in FIG. 7, to stop the downward motion of the central piston 36 of the pneumatic actuator 30 to which the pot gripper 26 is attached. The controller 62 also responds to the actuation of suction switch 58 by initiating the supply of compressed air to the lower port 48 on the pneumatic actuator 30 which causes the central piston 36 to retract until a magnetic sensor 64 indicates that the central piston 36 and the attached gripper 26 are in their retracted position.

In a similar manner, the flat gripper 28 is caused to reciprocate downwardly until the four suction cups 52, shown in FIG. 5, come in contact with the uppermost flat 22 at which time a suction-sensitive switch 58 detects engagement with the uppermost flat 22 and causes the controller 62 to initiate retraction of the flat gripper 28 to its retracted position.

Vibrators 120 are attached to the grippers 26, 28 and are activated as the grippers are retracted from the extended positions engaged with the nested stacks of pots 23 and flats 22 until the grippers are in their retracted position. By subjecting the grippers to vibration the grippers and attached pots and flats are in essence subjected to sinusoidal acceleration in the vertical direction. The small but rapid upward and downward acceleration causes the gripped pot or flat to move relative to the pots or flats nested beneath it. This movement overcomes the static coefficient of friction and allows the force of gravity to act on the lower pots or flats and to separate them from the gripped pot or flat.

In order to insure that the stacks of pots 23 and flats 20, which may be contained in their original shipping containers 66, 68, are aligned with the grippers 26, 28 positioning flanges 70, 72 are adjustable to accommodate various sizes of carton and are shown in FIG. 6.

The pneumatic actuators 30, 32 and the attached grippers 26, 28 and the associated guide rods 38 and the guide rod upper and lower bushings 40, 42 are mounted on subframes 74. The subframes 74 in turn are slidably mounted on cross rails 76 which allow the subframes 74 to be adjusted between the front 78 and the back 80 of the frame 24. The adjustability of the subframes 74 and the positioning flanges 70, 72 allows the apparatus 20 to accommodate a wide variety of plant flats and arrays of plant pots so that the apparatus 20 may be readily reconfigured as the needs of the user dictates.

A carriage 82 is mounted on vertical wheels 84 and horizontal wheels 86 best shown in FIG. 6. The wheels 84, 86 ride on the upper 88 and inside horizontal surface 90 of the crossbars 92 and constrain the carriage 82 to movement between the pot side 94 and the tray side 96 of the frame 24.

The crossbars 92 position the carriage between the top 34 and the bottom 44 of the frame 24 between the grippers 26, 28 in their retracted positions and the stacked arrays of pots 23 and flats 22. The carriage 82 is movable between a first position beneath the pot gripper 26 and a second position beneath the flat gripper 28 by means of a horizontal pneumatic actuator 98. The horizontal pneumatic actuator 98 is connected to a supply of compressed air by means of supply lines 100 which are connected to a first port 102 which supplies compressed air to cause the cylinder to extend and a second port 104 which causes the cylinder 103 of the actuator 98 to retract. The supply of compressed air to first port 102 and second port 104 is controlled by the controller 62. Magnetic sensors 107 are mounted on the horizontal pneumatic actuator 98 indicate to the controller 62 when the piston 103 is at the proper extension to position the carriage 82 in either the first position shown in FIG. 2 and 3 or the second position shown in FIG. 1.

A discharge pneumatic actuator 106 is mounted to the pot side 94 of the frame 24 and is connected to an L-shaped discharge bar 108 best shown in FIG. 6. The discharge cylinder has an extension port 110 and a retraction port 112 which are supplied with compressed air by lines 115 The flow of compressed air is controlled by the controller 62 and magnetic sensors 113 mounted on the cylinder which activates switches which are used by the controller 62 to sense the position of the discharge piston 114 and the attached discharge bar 108. Extension of the discharge piston 114 causes the short leg 116 of the L-shaped discharge bar 108 to discharge a flat 22 containing pots 23 from the second station of the carriage 82 onto a take-away conveyor belt 118 as shown in FIG. 4.

FIGS. 1–4 illustrate the continuous operational cycle of the apparatus 20 in denesting arrays of pots 23, placing the pots in individually denested plant flats 22, and discharging the assembled pots and flat onto a conveyor belt.

The apparatus 20 operates in a continuous cycle of upward and downward movements of the pistons and the attached grippers. Under control of the electronic controller, the two grippers will always descend from their retracted positions together, although the return motion will be in response to contact with a stack of pots or flats in a loading cycle or in response to reaching the level of the carriage in an unloading cycle.

The cycle achieves efficiency in repetitively moving the carriage from a position under the pot gripper to a position under the flat gripper, allowing one gripper to unload its contents on the carriage at the same time as the other gripper is loading from the nested pots or flats.

Figure 2:
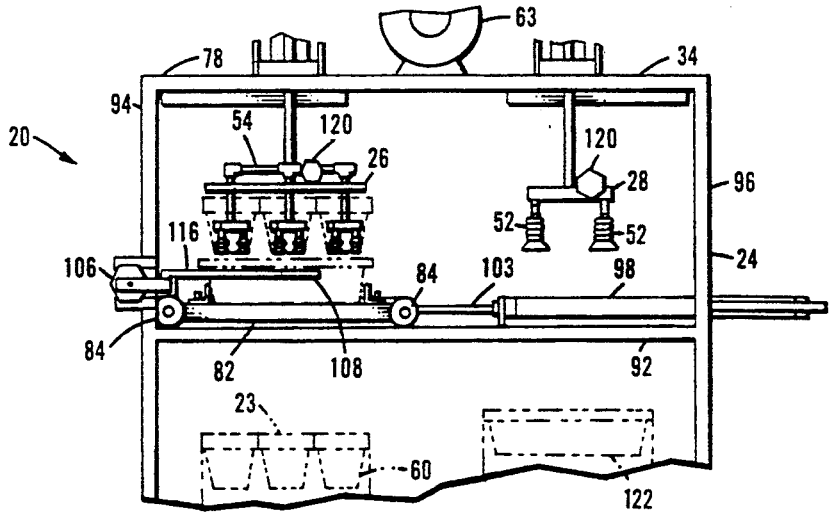
FIG. 2 is a front elevational view of the apparatus of FIG. 1 with the carriage positioned to receive an array of pots.
Figure 3:
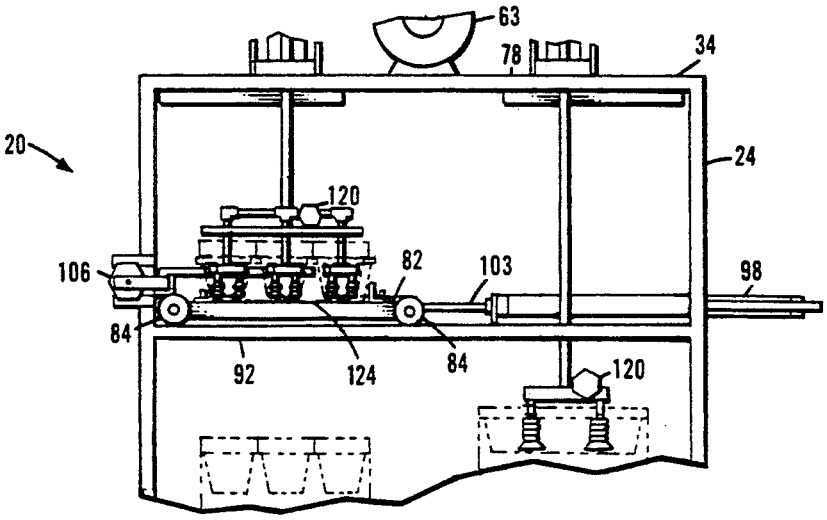
FIG. 3 is a partial front elevational view of the apparatus of FIG. 1 shown with the flat gripper in extended position for retrieving a plant flat.

The cycle is initiated with the flat gripper 28 in its retracted position as shown in FIG. 2. Under control of the programmable controller 62 compressed air is fed to the upper port 46 of the first pneumatic actuator 32 causing the central piston 36 and attached flat gripper 28 to descend until the gripper suction cups 52 are in contact with the bottom 122 of the uppermost flat 22 in the stack of nested flats disposed beneath the flat gripper 28 as shown in FIG. 3. Once the suction cups 52 are engaged with the flat bottom 122 a switch in pneumatic communication with the suction cups 52 signals the controller which retracts the gripper 28 by introducing compressed air to the lower port 48 of the second actuator 32. The flat gripper 28 returns to its retracted position and the carriage 82 is positioned beneath the flat gripper 28 and the attached flat 22 by actuation of the horizontal pneumatic actuator 98 which is supplied compressed air under the control of the controller 62.

Figure 1:
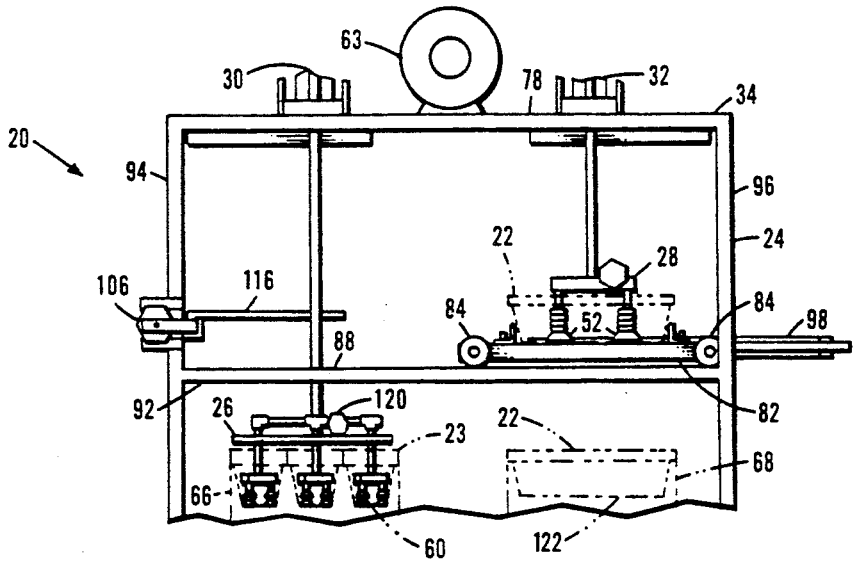
FIG. 1 is a partial front elevational view of the apparatus of this invention shown with the carriage in position to receive a plant flat.

As illustrated in FIG. 1, the flat gripper 28 with the attached flat is lowered into a release position where the attached flat is adjacent to the upper surface 124 of the carriage 82. The controller 62 senses the proper position of the gripper 28 by means of a magnetic sensor 117 mounted on the central piston 36 of the first actuator 32 which activates a switch when the gripper 28 is in the proper position for the release of the flat 22. The suction cups 52 attached to the gripper 28 are placed in communication by a valve 128 shown in FIG. 7 with the atmosphere or a source of compressed gas which causes the gripper 28 to release the flat 22 onto the carriage 82. The flat gripper 28 next returns to its retracted position as shown in FIG. 2 and the carriage 82 conveys the flat 22 to its second position beneath the pot gripper 26 clearing the way for the flat gripper 28 to descend and retrieve another plant flat 22.

While the flats gripper is descending to deposit a flat on the carriage, the pot gripper descends from its retracted position shown, in FIG. 2, to its extended position, shown in FIG. 1 where an array of $3\times6$ pots is grasped by an array of thirty-six suction cups 52. While the flat gripper 28 is retracted after depositing a flat on the carriage, the pot gripper with engaged pots is retracted to its elevated position. With both grippers 26, 28 retracted the carriage 82 and flat 22 are moved beneath the pot gripper 26 as shown in FIG. 2 by the horizontal pneumatic actuator 98 and positioned by the controller 62 responding to the magnetic sensor 107 and switch mounted on the horizontal actuator 98.

As shown in FIG. 3, the pot gripper 26 next descends to a release position where the pot bottoms 60 are adjacent to the flat bottom 122 at which point a magnetic sensor 117 activates a switch which causes the controller 62 to put the suction cups of the pot gripper in communication with atmospheric or superatmospheric pressure so releasing the arrays of pots 23 into the flat 22. The loaded flat 126 is then ejected from the apparatus 20 by the L-shaped discharge bar 108. The short leg 116 pushes the loaded flat 126 off the carriage 82 and onto the conveyor belt 118. The L-shaped discharge bar 108 is attached to the discharge pneumatic actuator 106. The discharge position of the actuator 106 and its retracted position are sensed by means of magnets 113 mounted on the discharge cylinder 114 which actuates switches as the discharge actuator moves to either the discharge or retracted positions.

When the supply of pots is exhausted the pot gripper will descend to its lowest allowable level, at which point a sensor 121 mounted on the actuator 30 detects the extension of the pot piston and signals the controller 62 which halts the operation of the apparatus until additional pots and flats are loaded and the apparatus 20 is restarted. A similar sensor may be supplied for the flat actuator if cartons containing different numbers of stacked pots and flats are to be employed.

A schematic illustration conveying the connections of the apparatus 20 shown is in FIG. 7 and shows the two pneumatic actuators 30, 32 for reciprocating the pot gripper 26 and the flat gripper 28, the pneumatic actuator 98 which moves the carriage 82 between a position beneath the flat gripper 28 and the pot gripper 26 and the pneumatic actuator 106 which reciprocates the discharge bar 108. Also illustrated are the air lines which supply the actuators with the compressed air required in their actuation. Vacuum or air is supplied to the grippers 26, 28 and their suction cups 52 by the vacuum source 56 which has valves 128 which alternately connects lines 54 with the suction cups 52 with vacuum and atmospheric or superatmospheric pressure. The controller 62 controls valves 130 which supply compressed air from pump 63 to the pneumatic actuators. The controller 62 is preferably a Telemecanique Model TSX 117 programmable controller, however any type of control logic device could be used. The controller 62 responds to sensors 64, 107, 113, 117, 98 which indicate the positions of the cylinders and whether the suction cups 52 are in sealed engagement with the bottoms of the flats and pots.

It should be understood that while the controller 62 is described as an electronic programmable controller, the controlling function could be performed by a fluidic logic, relay logic, or one of a number of mechanical logics such as those employing cams, punch cards, or paper tapes employing electronic, pneumatic or optical mechanization of a stored program of steps. Although the apparatus as illustrated and described employs pneumatic actuators, it should be understood that actuators employing hydraulics or rack and pinion actuators driven by electric, pneumatic or hydraulic motors could be employed and that furthermore belt-driven or chain driven reciprocating actuators might be employed and that furthermore linear induction or linear commutated motors or solenoids could be employed to develop the linear motion required by the apparatus 20.

It should also be understood that although the apparatus 20 is illustrated and described as placing an array of 18 pots within a single plant flat, two or more flats could be loaded at one time and the number of pots in the array of pots could correspondingly be varied. Furthermore, larger or smaller numbers of pots could be used with a given size plant flat and the plant pots may consist of an array of planting recepticles joined together.

It should further be understood that where the vibrators are shown and described as pneumatic in nature, they could equivalently employ rotating eccentric weights, acoustical transducers, piezoelectric or magnetic oscillators.

It should also be understood that where pneumatic suction cups are used to grip the pots and flats, mechanical grippers which wedge against the sides of the pots or flats could be used, or a tacky adhesive material in combination with a release plunger could be used to temporarily affix the pots and flats to the grippers of this invention.

It is understood that the invention is not confined to the particular construction and arrangement of parts herein illustrated and described, but embraces such modified forms thereof as come within the scope of the following claims.

We claim:

1. An apparatus for denesting stacked plant flats and pots in a plurality of stacks and filling the flats with the pots, comprising;

a) a frame;

b) a first actuator mounted to the frame and having a piston extendable between an elevated position and a lowered position;

c) a pot gripper mounted to the first actuator and adapted to selectably engage a single pot from each pot stack, wherein the pot gripper is extendable on the first actuator from an elevated position spaced above the stacked pots to a lowered position where the pot gripper engages with the uppermost pot in each pot stack;

d) a second actuator mounted to the frame parallel to the first actuator and having a piston extendable between an elevated position and a lowered position;

e) a flat gripper mounted to the second actuator and adapted to selectably engage a stacked flat, wherein the flat gripper is extendable on the second actuator from an elevated position spaced above the stacked flats to a lowered position where the flat gripper engages with the uppermost flat in the flat stack;

f) a carriage mounted to the frame and moveable from a first position spaced beneath the elevated flat gripper to a second position spaced beneath the elevated pot gripper;

g) a controller adapted to activate the actuators to control the elevation of the pot gripper and the flat gripper and to selectably operate the grippers to engage and disengage the pots and flat, and to control the position of the carriage to perform a cycle wherein a flat is lifted from the flat stack, deposited on the carriage, a plurality of pots are lifted from the pot stack and elevated and the carriage is moved beneath the elevated gripper-engaged pots and the pots are deposited within the flat.

2. The apparatus of claim 1 wherein each gripper comprises a plurality of resilent suction cups in pneumatic communication with a source of vacuum, and further comprising a valve between the vacuum source and the suction cups of each gripper, the valves being operable by the controller to selectably direct vacuum or atmospheric or greater pressure to the suction cups to alternatively engage or disengage articles from the grippers.

3. The apparatus of claim 1 further comprising a vibrator connected to the pot gripper and selectably operable by the controller to disengage pots frictionally held to a pot engaged by the gripper.

4. The apparatus of claim 1 further comprising a vibrator connected to the flat gripper and selectably operable by the controller to disengage a flat frictionally held to a flat engaged by the flat gripper.

5. The apparatus of claim 1 further comprising;

a) an actuator mounted horizontally to the frame and having a horizontally extensible piston; and b) a member connected to the piston of the horizontally mounted actuator and closely spaced above the carriage in the carriage second position, the member being adapted to engage against a pot-filled flat positioned on the carriage such that extension of the horizontal actuator piston will eject the filled flat from the apparatus.

6. The apparatus of claim 1 further comprising;

a) two horizontal rails connected to the frame beneath the carriage;

b) rotatable wheels connected to the carriage and engaged with the horizontal rails; and c) an actuator mounted to the frame with a piston extensible in the direction of carriage movement, wherein the actuator piston is connected to the carriage and is operable by the controller to position the carriage in the first and second carriage positions.

7. An apparatus for destacking plant flats and plant pots, and placing the pots within the flats comprising:

a) a frame;

b: a first means for reciprocatingly connecting a first gripper to the frame, the gripper reciprocating between a first retracted position and a multiplicity of second positions, the reciprocating means being adapted to position the gripper for engaging a flat uppermost in a stack of flats;

c) a means for gripping the uppermost flat and causing the flat to reciprocate with the first gripper;

d) a second means for reciprocatingly connecting a second gripper to the frame, the second gripper reciprocating between a first retracted position and a multiplicity of second positions, the second reciprocating means being adapted to position the gripper for engaging a multiplicity of pots uppermost in an array of stacked pots, wherein the array of pot stacks are positioned so that the uppermost pot from each stack in the array may be nested within at least a portion of a plant tray;

e) a second means for gripping uppermost pots in an array of stacked pots, causing the pots to move with the second gripper; and f) a means for receiving plant flats from the first gripper, the first gripper having a means for releasing a flat from the first gripping means so bringing the flat into contact with the means for receiving, wherein the means for receiving the flats positions the flats beneath the second gripper wherein the reciprocation of the second gripper places an array of pots filling at least a portion of the flat, the second gripper further having a release means for releasing the array of pots when the second reciprocating means positions the array of pots within the flat.

8. The apparatus of claim 7 wherein the stacks of pots and flats are free standing or are contained in their original shipping container, so that no magazine is used to contain or feed the pots and flats.

9. The apparatus of claim 7 wherein the receiving means reciprocates between a position beneath the first gripper where it receives a flat and a position beneath the second gripper where it receives an array of pots, further comprising a means for unloading a flat containing an array of pots from the receiving means.

10. The apparatus of claim 7 further comprising:

a) means for detecting first gripper engagement with an uppermost flat in a stack of flats; and b) means for controlling the first reciprocating means responsive to the engagement detecting means, the controlling means halting the downward motion of the first gripper.

11. The apparatus of claim 7 further comprising:

a) means for detecting second gripper engagement with an uppermost array of pots in an array of stacked pots; and b) means for controlling the first reciprocating means responsive to the engagement detecting means, the controlling means halting the downward motion of the second gripper.

12. The apparatus of claim 7 further comprising means for causing the vibration of the second gripper, so that the second gripper may be vibrated while it is moving between a position engaging the top of a stacks of pots in an array and the retracted first position so that a single array of pots will be removed from the stack of pots, the vibration facilitating the denesting of a pot immediately beneath the uppermost pots.

* * * * *